US011832673B2

(12) United States Patent
Capobianco

(10) Patent No.: US 11,832,673 B2
(45) Date of Patent: Dec. 5, 2023

(54) PROTECTIVE HEADGEAR DEVICE

(71) Applicant: Cheryl Capobianco, Palm Beach Gardens, FL (US)

(72) Inventor: Cheryl Capobianco, Palm Beach Gardens, FL (US)

( * ) Notice: Subject to any disclaimer, the term of this patent is extended or adjusted under 35 U.S.C. 154(b) by 261 days.

(21) Appl. No.: 17/287,488

(22) PCT Filed: Oct. 23, 2019

(86) PCT No.: PCT/US2019/057733
§ 371 (c)(1),
(2) Date: Apr. 21, 2021

(87) PCT Pub. No.: WO2020/086768
PCT Pub. Date: Apr. 30, 2020

(65) Prior Publication Data

US 2021/0378340 A1 Dec. 9, 2021

Related U.S. Application Data

(60) Provisional application No. 62/750,769, filed on Oct. 25, 2018.

(51) Int. Cl.
*A42B 1/0187* (2021.01)
*A42B 3/10* (2006.01)
*A42B 3/20* (2006.01)

(52) U.S. Cl.
CPC ..... *A42B 1/0187* (2021.01); *A42B 3/105* (2013.01); *A42B 3/20* (2013.01)

(58) Field of Classification Search
CPC ..... A42B 1/045; A42B 1/048; A42B 1/006; A42B 1/0187; A42B 1/24; A42B 1/20; A42B 1/18; A42B 1/06; A42B 1/00; A42B 3/105; A42B 3/20
USPC ..... 2/171
See application file for complete search history.

(56) References Cited

U.S. PATENT DOCUMENTS 4,032,012 A * 6/1977 Bishop ..... A42C 1/00 223/109 R
4,180,868 A * 1/1980 Snow ..... A42B 3/105 2/205
7,188,374 B2 * 3/2007 Carey ..... A42B 1/0186 2/205
8,333,485 B2 * 12/2012 Waters ..... A42B 1/244 206/8
9,546,030 B2 * 1/2017 Lombardi ..... D04B 1/24
2011/0107500 A1 * 5/2011 Wathen ..... A42B 1/0187 2/209.13

(Continued)

*Primary Examiner* — Gloria M Hale
(74) *Attorney, Agent, or Firm* — David P. Lhota, Esq.; Lhota & Associates, P.A.

(57) ABSTRACT

A protective headgear device for shielding the user from sunlight including a hat having a brim with an outer portion and an inner portion; wherein the inner portion has at least two hat magnets embedded therein and two grommets with opening along said brim; and a single piece of fabric having two side portions, a headband portion and a fabric opening in the middle which fits over the top portion and including at least two fabric magnets embedded therein; where the side portions of the fabric fit through the grommet so that the fabric magnets attach to the hat magnets to secure the fabric across the user's face, neck and shoulders.

13 Claims, 7 Drawing Sheets

(56) References Cited

U.S. PATENT DOCUMENTS

| | | | | |
|---|---|---|---|---|
| 2016/0058089 | A1* | 3/2016 | Niedrich | A42B 1/0187 2/172 |
| 2017/0156433 | A1* | 6/2017 | Chen | A42B 3/003 |
| 2017/0196280 | A1* | 7/2017 | Murphy | A41D 13/1161 |
| 2021/0339269 | A1* | 11/2021 | Kuntz | A62B 7/10 |

* cited by examiner

PROTECTIVE HEADGEAR DEVICE

CROSS-REFERENCE TO RELATED APPLICATION

This application claims the benefit of PCT application No. PCT/US19/57733 filed Oct. 23, 2019 which claims the benefit of U.S. provisional patent application Ser. No. 62/750,769 filed Oct. 25, 2018.

STATEMENT REGARDING FEDERALLY SPONSORED RESEARCH OR DEVELOPMENT

N/A

FIELD OF THE INVENTION

The present invention relates to headgear that protects the face, neck, and shoulders. More specifically, protective headgear devices are provided that have magnetic portions for fixing fabric materials containing magnets in place, in order to protect the skin of the user from sunlight and ultraviolet rays.

BACKGROUND OF THE INVENTION

Exposure to sunlight can cause numerous skin problems and conditions. Melasma is one of such conditions wherein exposure to sunlight causes patchy brown spots on the skin.

There are a variety of devices and products that have been developed to solve exposure to sunlight to curb the occurrence of sunlight related conditions. Representative of such devices and products include U.S. Patent Publication No. 2011/0107500 to Wathen which discloses headgear for protection against environmental effects and U.S. Pat. No. 7,991,278 to Klamerus which is essentially a hat cover and frame to protect the face and neck of the wearer.

U.S. Patent Publication No. 2011/0107500 to Wathen discloses a number of hats with fabric to protect the users face and neck. In FIG. 3A in Wathen two fabric panels and grommets in FIG. 3A are shown and said to be used as a "coupling portion". Paragraph 0074 describes multiple attachment means for the panels but does not disclose use of magnets. FIG. 5 shows the scarf (fabric) crisscrossing the face. FIG. 8A discloses a scarf loop. FIGS. 10 and 11 illustrate the covering being attached to a baseball cap using snap connectors.

U.S. Pat. No. 7,971,278 to Klamerus Jr. discloses a hat cover to protect the neck and face of the wearer. Klamerus discloses holes 28 for cooling and hook and loop fasteners for attaching a removable headband. Klamerus is directed to a head covering using Velcro to attach to a hat, not to attach fabric. There are no grommets in Klamerus used for pulling fabric through and there are no magnets used for attachment means.

U.S. Pat. No. 9,907,381 to Tussey discloses a hair wrap that uses magnets instead of button to secure the wrap. There is no hat in Tussey.

U.S. Pat. No. 5,881,389 to Fruge discloses a hood with ear openings that close and are held in place with magnets.

U.S. Patent Publication No. 2004/0010178 to Buckner discloses, in one embodiment, a magnetized hat band.

The prior art does not disclose headgear with grommets with fabric pulled through the grommets to secure to the headgear, nor does it disclose magnets as the means for securing the fabric to the hat brim. It is, therefore, to the effective resolution of the aforementioned problems and shortcomings of the prior art that the present invention is directed. The instant invention addresses this unfulfilled need in the prior art as contemplated by the instant invention disclosed herein.

SUMMARY OF THE INVENTION

In light of the foregoing, it is a general object of the invention is to provide headgear that includes a plurality of magnets on the inside of the hat brim. The fabric used in the invention, which when pulled through the grommets of the hat create two side panels. The ends of the fabric side panels include a plurality of magnets that are attached and secured to the magnets on the inside of the hat brim. The invention fabric unlike the prior art is used to cover the user's neck and shoulders.

The scarf fabric used in the invention is one piece with a hole cut out in the middle to fit over the brim of the hat to create two connected side panels.

Another object of the invention is to provide a kit embodiment made of scarfs with magnets and grommets that are retro-fitted into a hat. The hat itself either has magnets embedded in the brim or additional smaller sized metal grommets on the back of the hat for attachment to the scarf fabric magnets.

Yet another object of the invention is to provide a unique adjustable device to protect the face, neck, and shoulders. The fabric can be "bustled" at the back to shorten it, or if let down, easily rests on the shoulders.

Another object of the invention is to provide a magnet attachment clipped to the undergarments of the user, to secure to the fabric on the shoulders in windy conditions.

Yet another object of the invention is in the provision of protective headgear which has a polished and fashionable look, to appeal to women and men, and to coordinate with clothing and accessories. The hat with fabric scarf can be made in an assortment of colors and design selections.

Still another object of the invention is in the provision of hats with different size brims. Some hats will have a larger brim, while others will have a shorter brim, to allow for athletic activities.

Still another object of the invention is to provide fabric scarves in many styles and colors to compliment the style and color of hat and as desired by the user.

In the present invention, these purposes, as well as others which will be apparent, are achieved generally by providing a protective headgear device with open grommets fitted with fabric to cover a user's neck and shoulder, wherein the fabric has magnets which is secured to the headpiece which has embedded magnets to securely hold the fabric in place.

Alternatively, the fabric magnets can be secured directly to additional metal grommets on the hat brim.

The scarf fabric is a unique singular piece with a hole cut in the middle which fits over the hat brim with the two side pieces sliding through the open grommet sides to create to side panels.

The invention also includes do it yourself kits made of scarfs with magnets and magnets that can be retro-fitted into a hat. The kit also includes metal grommets that can be retro-fitted into a hat.

Other objects, features and advantages of the present invention will be apparent when the detailed description of the preferred embodiments of the invention are considered with reference to the drawings, which should be construed in an illustrative and not a limiting sense.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
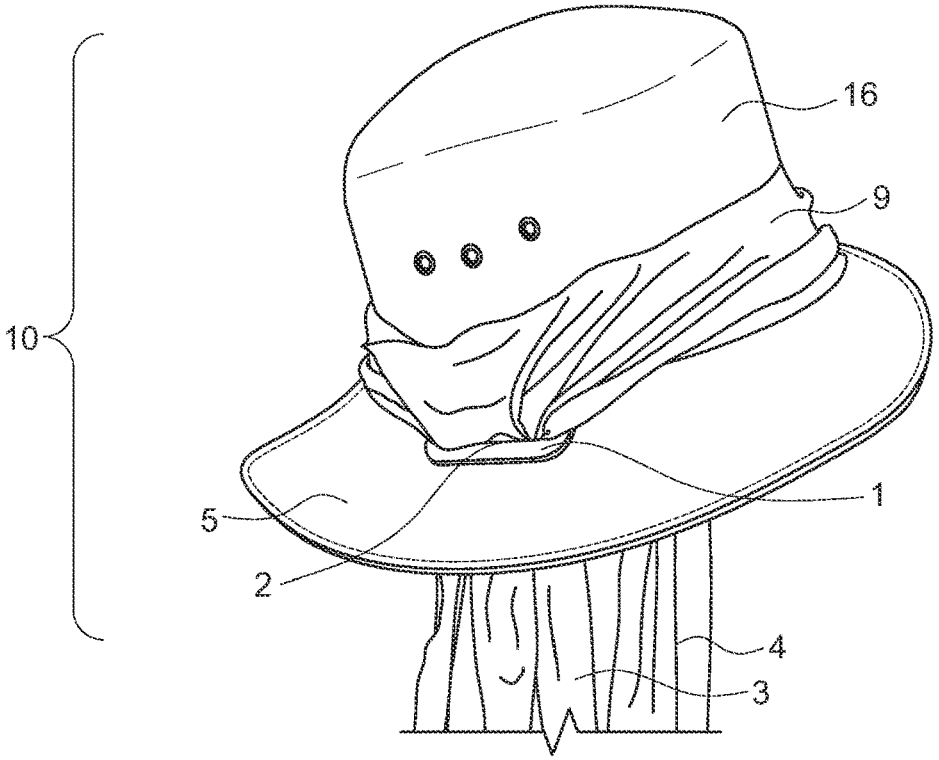
FIG. 1 is an illustration of an outer embodiment according to the invention showing the fabric piece and insertion into the grommet.

With reference to the drawings in which like reference designators refer to like elements, FIGS. 1 to 9 depict the preferred and alternative embodiments of the instant invention, which is generally referenced as a protective headgear device, headgear device and or by numeric character 10. Referring to the drawings, the protective headgear device 10 includes a design that protects one's head, neck and face from sunlight, wind, airborne germs, or viruses and, or tactile germs or viruses. In accordance with the present invention, the headgear device 10 includes and has structures and structural elements referenced by the noted reference numerals as defined in FIGS. 1-9 of the drawings, as follows:

1—Grommet;
2—Grommet opening;
3—Fabric—side right portion;
4—Fabric—side left portion;
5—Hat brim—outer portion;
6—Hat brim—inner portion;
7 —Hat Magnets—embedded in hat brim;
8—Fabric Magnets—embedded at the end of the fabric side portions;
9—Fabric—head band portion;
10—Hat;
11—Hat Magnets—helmet embodiment;
12—Fabric Magnets—helmet embodiment;
13—Fabric—face cover;
14—Fabric—shoulder cover;
15—Opening in Fabric portion to place over hat;
16—Top hat portion;
17—Outer surface—helmet embodiment;
18—Inner surface—helmet embodiment;
19—Top portion of cap;
20—Brim portion of cap;
21—Scarf for cap embodiment;
22—Opening on top of scarf (cap embodiment);
23—scarf fabric panel right side;
24—scarf fabric panel left side;
25—scarf magnets (cap embodiment);
26—attachment/release means on front side of hat device;
27—fabric piece covering back of neck;
28—fabric piece covering front face and neck;
29—head band fabric portion;
30—scarf magnets As illustrated in FIG. 1, a headgear device for shielding the user from sunlight is provided. The device includes a hat 10 has a brim with an outer portion 5 and an inner portion 6 and a fabric scarf portion.

The hat portion of the invention can be made of paper straw, polyester, nylon, canvas, or cotton, although other materials can certainly be used.

The inner portion 6 of the brim has at least two hat magnets 7 embedded therein. Preferably, at least four hat magnets are used in the invention, although any number can be used to correspond to the fabric magnets in the invention.

There are two grommets 1 along the hat brim 5 where each grommet has an opening 2 where the fabric fits through.

The grommet opening 2 is between 0.5 to 4.5 inches long and 0.25 to 1 inch wide. The dimensions of the grommet vary depending on the end user, whether it is a man, woman, or child. The preferred size is approximately 10 mm or ½ inch wide and 3.5 inches long.

The preferred location of the grommets is close to the junction of the brim and the body of the hat. When on the user the grommets are adjacent to the user's ears.

Metal grommet used in the invention are smooth surfaced and haven finished quality without any sharp edges. The grommets cannot react with the magnets since the fabric-scarf magnets must be fed thought the opening of the grommet and cannot get stuck.

A single piece of fabric is used in the invention. the single piece of fabric is between 50 to 60 inches in length and between 8 to 15 inches wide. Most preferably, the fabric or scarf portion is 56 inches in length and 13.25 inches wide.

The fabric has a head band portion 9 which has been cut out to fit over the top of the hat 16 leaving two side portions, a side right portion 3, and a side left portion 4. These side portions 3 and 4 fit through the grommet openings 2 on either side of the hat.

The fabric portion has an opening 15 in the middle and fits over the top portion 16 of the hat. The opening 15 is preferably oval in shape and approximately 5 to 8 inches wide. Most preferably, the opening is 6.5 inches by 5 inches.

At the ends of each side portion are at least one fabric magnet 8 which attaches to the hat magnets 7 on the brim to secure the fabric across the user's face, neck, and shoulders.

Figure 2:
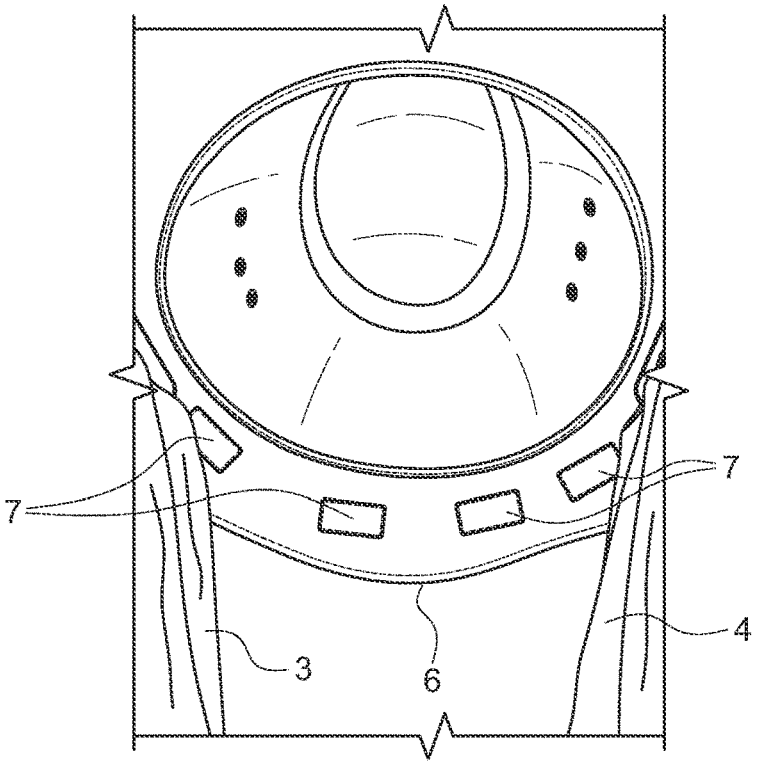
FIG. 2 is an illustration of an inner embodiment according to the invention, showing the placement of the hat magnets and the side panel fabric pieces.

The magnets in the invention are used to secure the scarf to the hat by attaching to magnets embedded inside the hat brim 7 as shown in FIG. 2. This allows flexibility and adjustability to the scarf around the face, neck, and shoulders. The magnets in both the scarf and hat are preferably stainless steel and are small and round in design. They are able to connect with each other but can easily detach.

The magnets are small enough, approximately 3 to 4 mm, to also slide into the thin hem of the scarf and be secured there. Once the scarf magnet and hat magnet or grommet come in contact a secure connection is made to hold in place.

Figure 3:
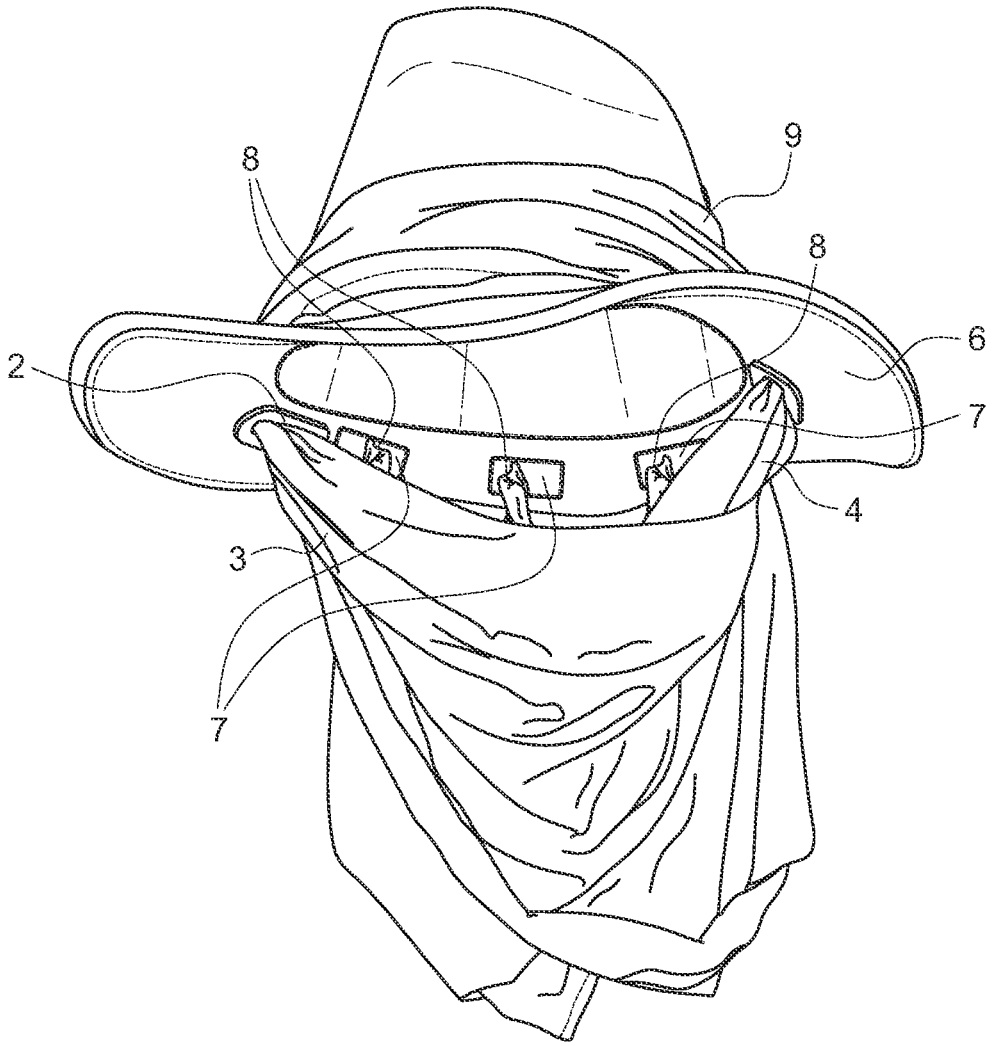
FIG. 3 is an overall frontal illustration according to the invention wherein the side panel fabric pieces with embedded fabric magnets are arranged across the front of the hat and affixed to the inner brim of the hat to the hat magnets to hold in place.

As shown in FIG. 3, the ends of each side portion (3), (4) there is at least one fabric magnet (8) which attaches to the hat magnets (7) to secure the fabric in place across the user's face, neck, and shoulders.

The layout of the magnets used in the invention on both the hat portion and the fabric scarf portion can vary. Preferably, up to twelve magnets can be used on the hat portion and up to twelve magnets can be used on the fabric-scarf portion.

Figure 4A:
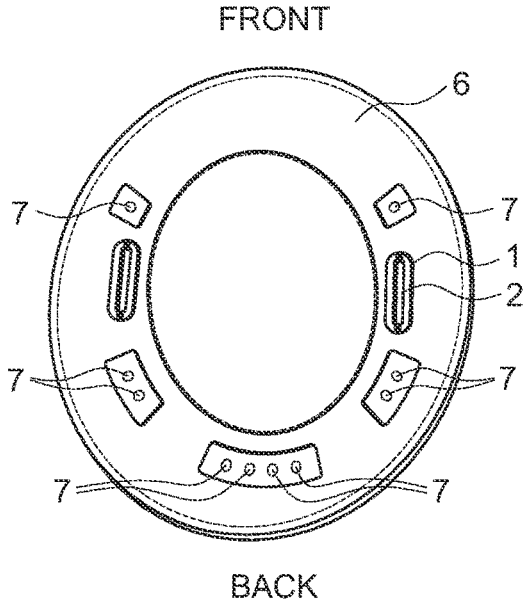
FIG. 4 illustrates the hat magnet placement according to the invention and includes FIG. 4A which illustrates the placement of the hat magnets on the inner brim of the hat.
FIG. 4B is an alternate illustration of the placement of the hat magnets on the inner brim of the hat.

FIG. 4 illustrates the hat magnet placement according to the invention and includes FIG. 4A which illustrates the placement of the hat magnets on the inner brim of the hat. In this illustration one magnet 7 is placed approximately ½ inch in front of the grommet 1 on either side of the inner brim 6. Two magnets 7 are placed approximately 1 inch behind on the back side of the grommet 1 on either side of the inner brim 6. Four magnets are also placed on the back side of the brim, measuring approximately 3 inches across.

Figure 4B:
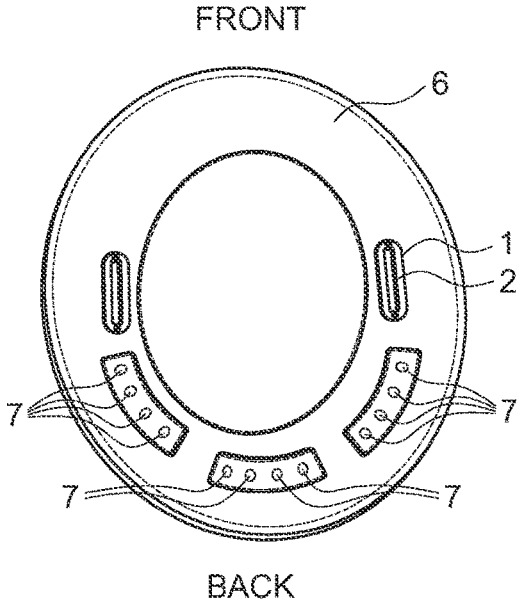

FIG. 4B an alternate illustration of the placement of the hat magnets on the inner brim of the hat is shown. instead of a magnet being placed in front of the grommet 1, four magnets are placed approximately 1 inch behind the grommet.

The varying positions of the magnets on the hat permit the fabric portion of the device to be placed in different positions across the users, face, back and shoulders. The magnets are generally hidden from the user under the brim of the hat, preferably at the curve of the brim.

The magnets are preferably embedded into the brim 6 to blend into the surface. However, the user can easily locate the magnets by feeling where they are.

While these figures illustrate that small round magnets are being used, other shapes can be used. For example, where the four small round magnets are used on the hat, it is within the scope of the invention to replace these small round magnets with one single thin magnet. The magnets can be a strip magnet or arc shaped magnet. In lieu of a magnet in the brim a metal strip, either straight or arc shaped can be used to attach the scarf magnets too.

It is important that the small slim round magnets are used in the scarf so that they can fit through the grommet and so that they will not stick to each other unless the user's desire them too.

Further, optionally, a mesh lining for housing the magnets on the underside of the hat brim can be used. This mesh lining must be strong enough to hold the magnets on the hat in place so that they do break though.

Figure 5:
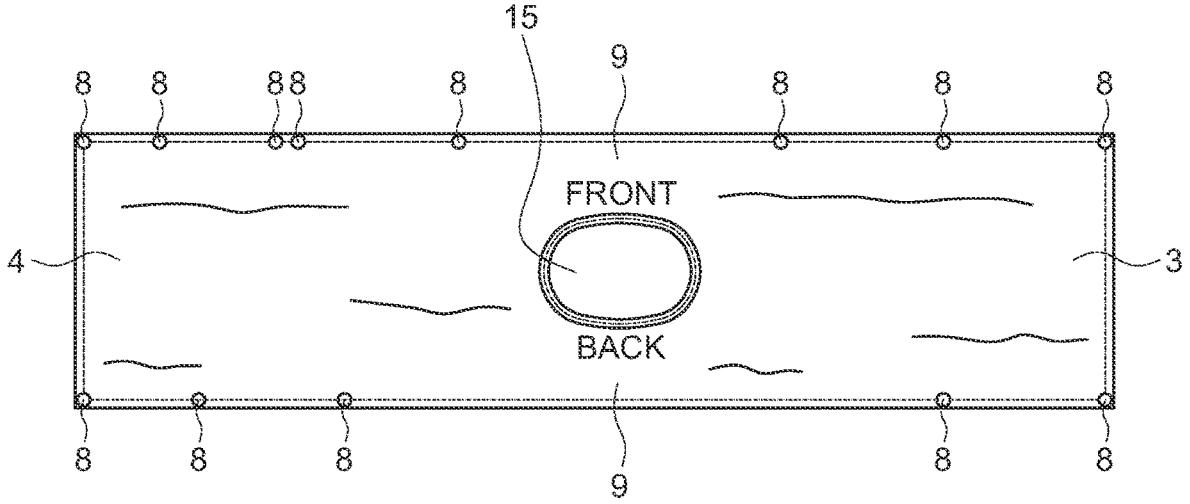
FIG. 5 is an illustration of the fabric portion according to the invention, illustrating the preferred positions of the embedded fabric magnets on the front and back sides of the fabric.

FIG. 5 is an illustration of the fabric portion according to the invention, illustrating the preferred positions of the embedded fabric magnets on the front and back sides of the fabric.

While the layout of the fabric magnets 8 can be in a variety of positions, this illustration, shows a preferred positioning, where the entire scarf (fabric) is 56 inches in length and 13.25 inches wide. A preferred layout of the magnets 8 on the front side of the fabric are at approximately 0", 4", 10.5", 11.5", 20', 46", 51", 56" and on the back side of the fabric at approximately 0", 6", 15.5", 50" and 56". The magnets at the ends (0 inches) are somewhat thinner and of less strength than the other magnets so that there is a gentle grabbing of the fabric at the end.

Other layouts are possible and within the scope of the invention. The layout of the fabric magnets depend on the design element desired for the placement of the fabric portion.

The fabric used in the invention is preferably made of ultraviolet protection fabric referred herein as a "UPF fabric". UPF is a rating generally used for clothing and other fabrics that protect you from the sun. It measures the amount of UVA and UVB radiation that penetrates the fabric and reaches the skin. The fabric can be interchanged with different patterns and weight of fabric, depending on the weather and activity. For warmer climates, the fabric is lightweight and breathable. Moisture wicking allows skin to remain protected, but cool. A preferable fabric used in the invention has a stretch, or Lycra® quality that allows some adjustability of the fit over the face. Preferably, the fabric has a Lycra® or spandex stretch quality with a UPF rating of 30-50.

Figure 6:
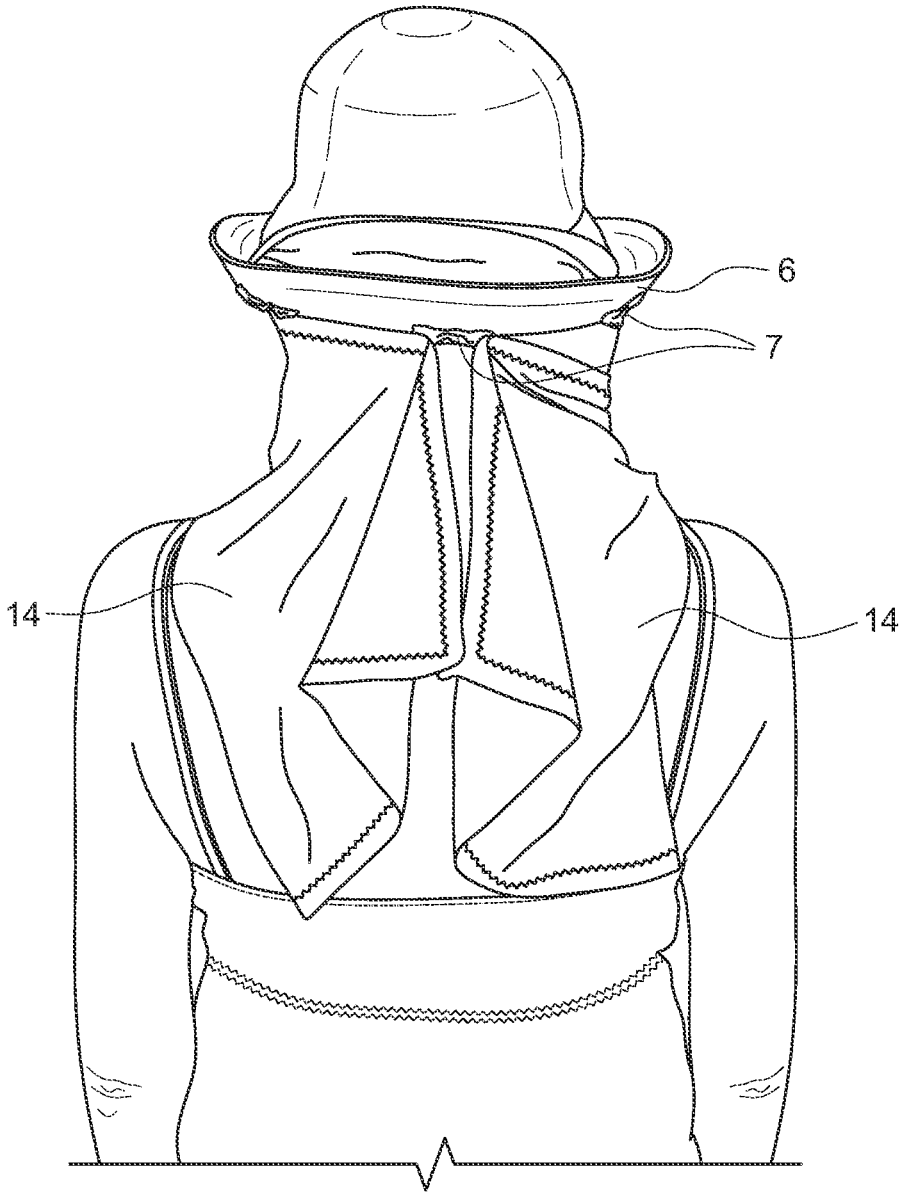
FIG. 6 is an illustration of an alternate embodiment of the invention, wherein the fabric portion has magnets which attach and bustle to the back portion of the hat and drapes around the user's shoulders like a cape.

FIG. 6 is an illustration of an alternate embodiment of the invention, wherein the fabric portion has magnets which attach to the back portion of the hat 7 and drapes around the user's shoulders 14 like a cape. This embodiment is for use in high wind situations where the shoulders stay protected with the scarf.

The protective headgear of the invention comes in various sizes that can be worn by men, women, and children. The average hat dimensions for adults are approximately between 6.5 and 7.5 inches and scaled appropriately smaller for children.

The type and style of hat used in the invention includes a fedora style, a tapered brim (sporty style), bucket style, helmet, cap, visor or other wider brimmed hat. Preferably the brim of the hat is approximately 3 inches.

Other options encompassed within the invention include the following variations:

- small/medium sizes which measures 6.5" width opening, 7¾" length opening
- large/XL sizes which measures 7" width opening, 8: length opening
- 4 magnets at back of hat which measures 2¾" width small/medium. 3¼" width large/XL
- 2 magnets 1" behind the grommets on each side of the hat brim that are small/medium, 3 magnets on side for large/XL size hats
- 1 magnet ½" in front of grommets on both sides of the hat brim, slightly anterior (inside).

Figure 7A:
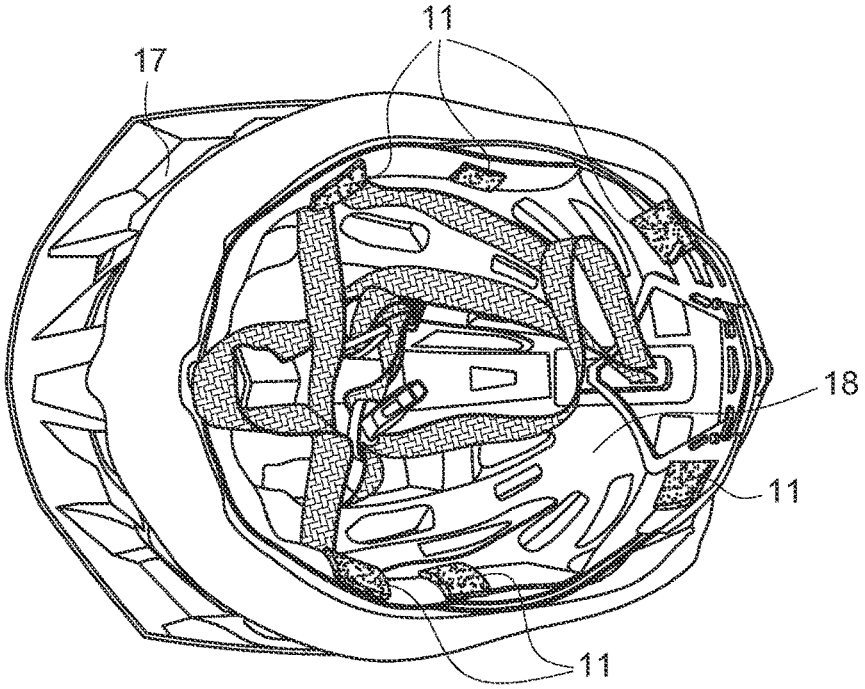
FIG. 7 is an alternate embodiment of the invention wherein the hat is a bicycle helmet and includes FIG. 7A which illustrates the inner part of the helmet showing the placement of the hat magnets.
FIG. 7B which illustrates the placement and attachment of the fabric magnets on the hat magnets.
FIG. 7C which illustrates the fabric portion protecting the user's face and securely affixed to the helmet/hat.

FIG. 7 is an alternate embodiment of the invention wherein the hat is a bicycle helmet and includes FIG. 7A which illustrates the inner part of the helmet showing the placement of the hat magnets 11 the interior portion 18 of the helmet. In this illustration, three hat magnets 11 are attached to the inside of the helmet/hat. It is within the scope of the invention that any number of hat magnets can be used as long as the fabric portion 13 is held in place.

The hat magnets can be embedded into the inner portion of the helmet by any means including but not limited to by adhesive or glue, or with a hook and loop material. Alternatively, the magnets in this embodiment can have a sticky surface i.e., sticky tape, on one side to affix to the inside of the helmet/hat. In an alternate embodiment the magnet can be sewn into the lining of the helmet.

Figure 7B:
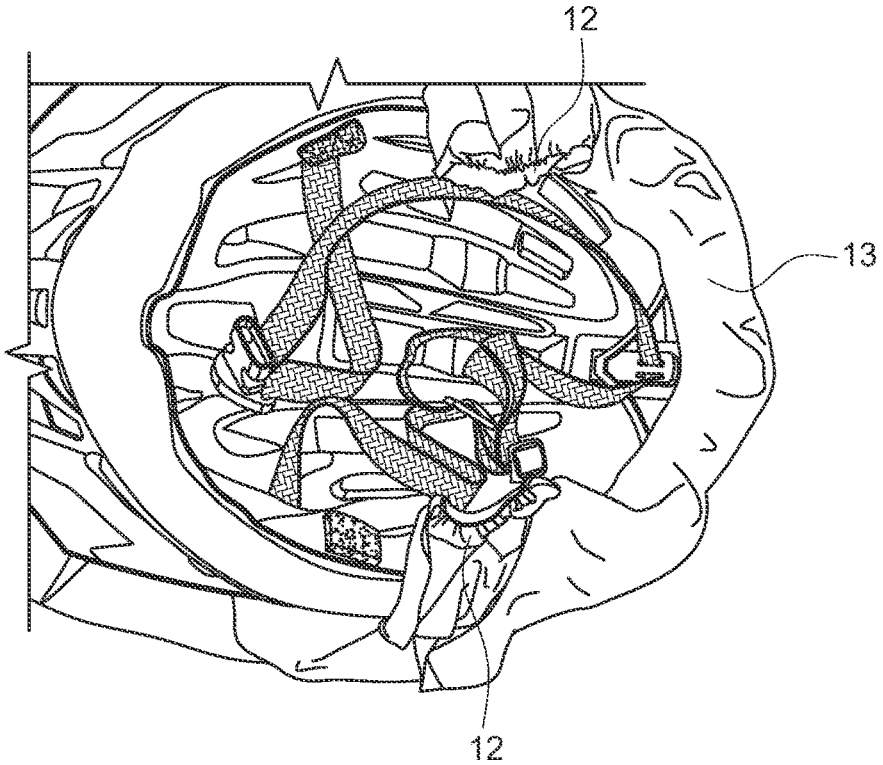

FIG. 7B illustrates the placement and attachment of the fabric magnets 12 on the hat magnet 11.

Figure 7C:
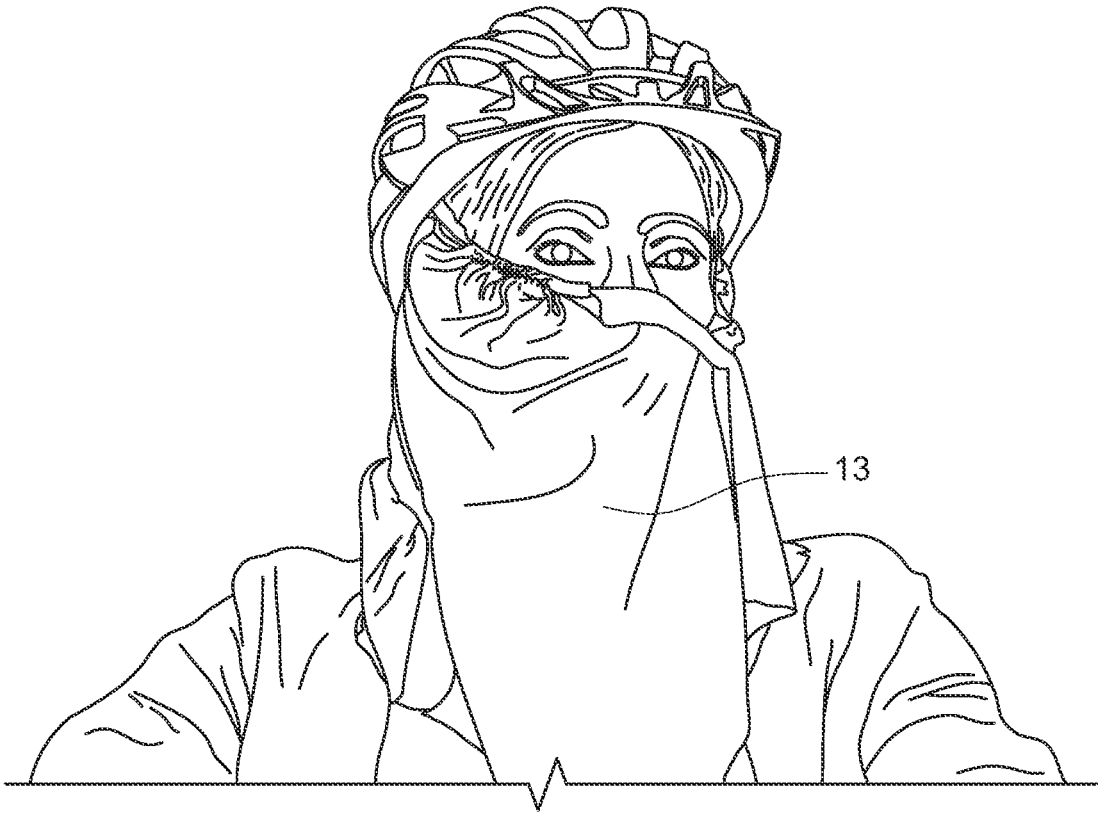

FIG. 7C illustrates the fabric portion 13 protecting the user's face and securely affixed to the helmet/hat. The scarf/fabric portion can be attached directly to the helmet with magnets or a hook and loop material. Alternatively, the scarf portion can be attached to a beanie or skull cap that is put on by the user first and then the helmet is placed on top of the skull cap.

Figure 8:
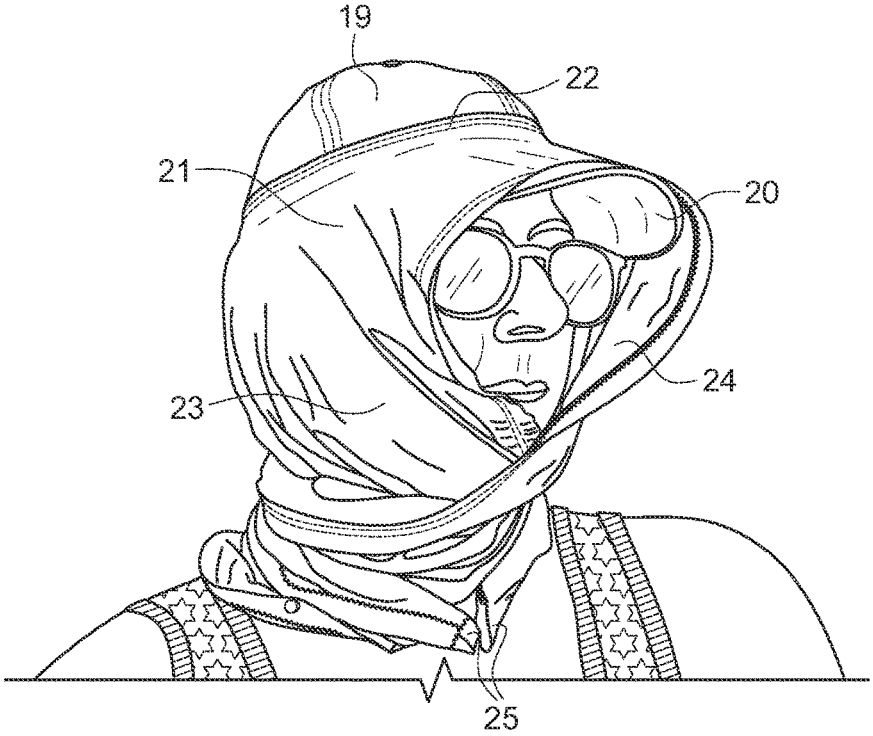
FIG. 8 is an alternate embodiment of the invention where the hat is a baseball cap or visor.

While the foregoing embodiment illustrates a helmet, other headgear is included such as baseball caps, visors, etc. Specifically, FIG. 8 illustrates another alternate embodiment of the invention where the hat is a baseball cap or visor. The baseball hat has a top 19 and a brim 20. The fabric/scarf portion is one piece with an opening on the top 22 for placement over the hat top 19. The side panels of the fabric fall on either side of the cap, in particular right side panel 23 and left side panel 24. The user crosses the two side panels across their face and around their neck and secure together in front with scarf magnets 25.

Figure 9:
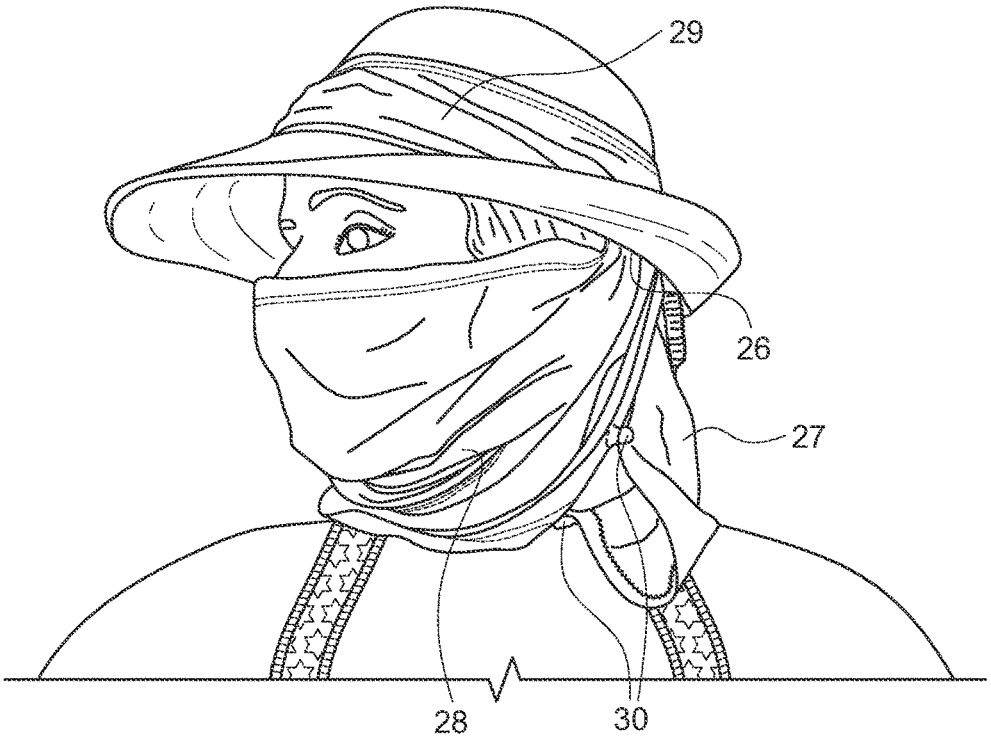
FIG. 9 is another alternate embodiment illustrating a side piece attachment/release means on the front side of the hat device. The scarf in this embodiment can be a single piece of fabric or two separate places.

FIG. 9 is another alternate embodiment illustrating a side piece attachment/release means 26 on the front side of the hat device. The scarf 28 in this embodiment can be a single piece of fabric or two separate pieces 28, 27 which can be attached by scarf magnets 30.

The attachment/release means 26 is a scarf magnet that attaches to a hat magnet on the brim of the hat. The frontal fabric piece 28 can then be easily attached and secured across the users face and can also be easily removed in one action.

In the two-piece scarf version, one piece fits over the hat and is secured with both hat and scarf magnets are described in the earlier embodiments. There also is a back flap portion that is adjustable and removable to cover the back neck portion of the user. This back flap attaches to the main part of the scarf with scarf magnets. The hat could be a bucket, fedora, or baseball cap style.

An alternate embodiment, the draped scarf attaches directly to the temple area of the hat with no grommets or buttonholes, on one or both sides. The second piece attaches are described above with scarf magnets.

In both the above embodiments, the fabric piece can be a single piece, rather than two separate pieces.

Different style headgear hats are encompassed by the invention. In general, the hats are fedora style are either a resort style or a sport style. Both use the main wrap around scarf that covers the face and extends the shoulders, but these hats can also encompass a second scarf, as described above in FIG. 9. This second scarf is preferably a water-friendly material that if it gets wet can be "squeezed out" and put back in place. The hat itself is made of the same materials as a conventional bathing suit.

In most of the embodiments there are three steps in wrapping and securing the scarf of the invention over the user's face, neck, and shoulders.

In the first step the user holds the scarf two side panels about half way down each side panel and crosses each panel across the users face and attaches the scarf magnet behind each grommet on the hat on either side to cover the front of the user's face, neck, and shoulders.

In the second step each side panel is picked up around the user's shoulders and attaches to the back side of the hat using scarf magnets attached to the hat brim magnets to secure in place. This covers the back of the user's neck.

In the third step, the user takes the front portion of each side of the scarf and pulls to the back side of the user to attach to the back side of the brim to create a bustle as illustrated in FIG. 6.

Alternatively, if this third step is not followed attachments can be used to secure the side panels to the user's clothing so that the fabric is held in place to cover the user's shoulders. These attachments are decorative magnets that would be secured to the shoulder or chest area of the scarf for use in windy conditions. The scarf will remain in place by attaching metal clips, with or without magnets, to the undergarments, or magnets can be sewn into the seams of the undergarment or UPF shirt or coverup.

Once in place on the user, the fabric-scarf portion covers the user's mouth, nose, ears, neck, and shoulders.

The scarf is taken off by the user by undoing the magnets in the reverse manner they were attached.

The invention also provides a kit wherein the scarf fabric is provided with embedded magnets or the fabric magnets can be added by the user.

Any hat can be retro-fitted with grommets and embedded hat magnets to transform into the invention.

The kit for making a protective headgear device for shielding the user from sunlight includes a hat having a brim with an outer portion 5 and an inner portion 6; at least two metal grommets 1 each having an opening 2; a single piece of fabric having two side portions 3, 4, a headband portion 9, an opening 15; at least one hat magnet 7; and at least one fabric magnet 8. The grommets are fitted to the hat brim. The desired number of hat magnets 7 are attached and embedded to the inner portion 6 on the hat. The number of fiber of fabric magnets 8 corresponding to the hat magnets are attached and embedded to side portion 3 or 4; such that the single fabric piece side portions 3, 4 are feed through each grommet 1. When in use the user places the headgear on their head and attaches the hat magnets to the fabric magnets to secure the fabric across the user's face, neck, and shoulders.

It will be appreciated by persons skilled in the art that the present invention is not limited to what has been particularly shown and described herein above. In addition, unless mention was made above to the contrary, it should be noted that all of the accompanying drawings are not to scale. The foregoing description of various and preferred embodiments of the present invention has been provided for purposes of illustration only, and it is understood a variety of modifications and variations are possible in light of the above teachings without departing from the scope and spirit of the invention as set forth and which is limited only by the following claims.

What is claimed is:

1. A protective headgear device for shielding predetermined portions of a user from sunlight comprising:

a headgear piece for engaging the user's head, said headgear having a top portion and a brim with an outer portion and an inner portion;

at least one grommet along said brim wherein said grommet has at least one opening;

a single piece of fabric having a side right portion, a side left portion, and a headband portion; wherein said fabric has an opening proximal a midsection that fits over said top portion of said headgear such that ends of each side portion are fitted through said grommet opening such that said fabric at least partially covers the user's face, neck, and shoulders.

2. The protective headgear device according to claim 1, wherein said inner portion of said headgear has at least one magnet embedded therein.

3. The protective headgear device according to claim 2, wherein at ends of each said side portion there is at least one fabric magnet that attaches to said headgear magnet to secure said fabric in place across the user's face, neck, and shoulders.

4. The protective headgear device according to claim 2, wherein said inner portion has a plurality of headgear magnets embedded therein.

5. The protective headgear device according to claim 3, wherein the fabric portion has a plurality of fabric magnets embedded therein coinciding with said headgear magnets.

6. The protective headgear device according to claim 1, wherein said fabric is comprised of material selected from the group consisting of cotton, stretch material, rayon, synthetic fabrics, water-proof fabrics, ultraviolet protection fabrics.

7. The protective headgear device according to claim 3, wherein said hat magnet is strong enough to secure to said fabric magnet.

8. The protective headgear device according to claim 3 wherein said fabric magnet is slim enough to fit through said grommet opening.

9. The protective headgear device according to claim 1, wherein said grommets are made of metal or plastic.

10. The protective headgear device according to claim 7, wherein said grommet opening is between 0.5 to 4.5 inches long and 0.25 to 1 inch wide.

11. The protective headgear device according to Clam 1, wherein the single piece of fabric is between 50 to 60 inches in length and between 8 to 15 inches wide.

12. The protective headgear device according to claim 1, wherein said opening is approximately 5 to 8 inches wide.

13. A protective headgear device kit for making a protective headgear device for shielding a user from sunlight comprising:

a head piece having a brim with an outer portion and an inner portion;

at least two metal grommets each having an opening;

a single piece of fabric having two side portions, a headband portion, an opening;

at least one head piece magnet; and at least one fabric magnet, wherein said grommets are fitted to said hat brim; said head piece magnet is attached and embedded to said inner portion and said fabric magnet is attached and embedded to a side portion; such that said single fabric piece side portions, are fed through each grommet and at least one fabric magnet attaches to said head piece magnet to secure the fabric across the user's face, neck, and shoulders.

* * * * *